US010134551B2

(12) United States Patent
Potter et al.

(10) Patent No.: US 10,134,551 B2
(45) Date of Patent: Nov. 20, 2018

(54) GALVANICALLY ISOLATED HYBRID CONTACTOR

(71) Applicant: Astronics Advanced Electronic Systems Corp., Kirkland, WA (US)

(72) Inventors: Frederick J. Potter, Trumbauersville, PA (US); Patrick Mills, Bradenton, FL (US)

(73) Assignee: ASTRONICS ADVANCED ELECTRONIC SYSTEMS CORP., Kirkland, WA (US)

( * ) Notice: Subject to any disclaimer, the term of this patent is extended or adjusted under 35 U.S.C. 154(b) by 0 days.

(21) Appl. No.: 15/271,373

(22) Filed: Sep. 21, 2016

(65) Prior Publication Data

US 2018/0082814 A1 Mar. 22, 2018

(51) Int. Cl.

| | |
|---|---|
| ***H01H 9/20*** | (2006.01) |
| ***H01H 47/00*** | (2006.01) |
| ***H01H 51/30*** | (2006.01) |
| ***H01H 49/00*** | (2006.01) |

(52) U.S. Cl.

CPC ..... *H01H 47/007* (2013.01); *H01H 49/00* (2013.01); *H01H 51/30* (2013.01)

(58) Field of Classification Search

CPC ..... H01H 9/00; H01H 67/02; H01H 75/00; H01H 77/00; H01H 80/00; H05K 7/20

USPC ..... 335/126, 161

See application file for complete search history.

(56) References Cited

U.S. PATENT DOCUMENTS 2,725,488 A * 11/1955 Hueffed ..... H01H 51/065 290/36 R
3,103,563 A * 9/1963 Grenier ..... H01H 1/20 335/145
3,364,450 A * 1/1968 Conner ..... H01H 50/22 335/170
3,388,353 A * 6/1968 Isler ..... H01H 11/0012 335/132
3,441,800 A * 4/1969 Lee ..... H01H 9/56 218/140
3,544,929 A * 12/1970 Kussy ..... H01H 1/2083 335/126
3,688,230 A * 8/1972 Tichy ..... H01H 50/42 335/201
3,745,492 A * 7/1973 Grunert ..... H01H 50/32 335/167
3,942,144 A * 3/1976 Contal ..... H01H 50/546 335/132
4,068,200 A * 1/1978 Krueger ..... H01H 9/342 200/50.1
4,129,843 A * 12/1978 Keller ..... H01H 71/345 335/174

(Continued)

*Primary Examiner* — Shawki S Ismail
*Assistant Examiner* — Lisa Homza
(74) *Attorney, Agent, or Firm* — Wiggin and Dana LLP; Gregory S. Rosenblatt; Andrew D. Bochner

(57) ABSTRACT

A hybrid contactor device that provides the ability to use the device with both AC and DC circuits is provided. The hybrid contactor includes a series-parallel arrangement of mechanical contacts with solid state devices, increasing the switching capacity of the mechanical contacts, and maintains galvanic isolation when open. The hybrid contactor includes two mechanical contacts, and is arranged so that one contact closes shortly before the other. The second contact forms a parallel circuit with an electronic switch.

13 Claims, 3 Drawing Sheets

(56) References Cited

U.S. PATENT DOCUMENTS 4,259,652 A * 3/1981 Mattson ..... H01H 50/28 335/128
4,266,105 A * 5/1981 Perkins, Jr. ..... H01H 71/126 200/325
4,307,361 A * 12/1981 Grunert ..... H01H 50/541 335/132
4,401,863 A * 8/1983 Lemmer ..... H01H 1/2083 200/16 A
4,475,094 A * 10/1984 Grenier ..... H01H 50/32 335/138
4,484,165 A * 11/1984 Grenier ..... H01H 50/32 335/165
4,529,953 A * 7/1985 Myers ..... H01H 51/005 335/126
4,590,449 A * 5/1986 VanTielen ..... H01H 50/047 335/126
4,631,507 A * 12/1986 Guery ..... H01H 71/2409 335/173
4,644,308 A * 2/1987 Guery ..... H01H 9/02 200/307
4,688,011 A * 8/1987 Lemmer ..... H01H 71/0228 335/120
4,713,636 A * 12/1987 Lemmer ..... H01H 71/0207 335/172
4,808,952 A * 2/1989 Berner ..... H01H 71/1081 335/119
4,931,757 A * 6/1990 Lemmer ..... H01H 89/06 335/131
4,973,929 A * 11/1990 Duchemin ..... H01H 89/08 335/132
5,119,053 A * 6/1992 Mostosi ..... H01H 89/08 335/172
5,256,992 A * 10/1993 Fasola ..... H01H 1/50 335/126
5,293,521 A * 3/1994 Blanchard ..... H01H 9/22 335/132
5,500,630 A * 3/1996 Edwards, Jr. ..... H01H 71/1054 335/132
5,502,426 A * 3/1996 Blanchard ..... H01H 89/08 335/132
5,517,167 A * 5/1996 Yamamoto ..... H01F 5/04 335/132
5,638,038 A * 6/1997 Suzuki ..... H01H 9/542 335/35
5,684,442 A * 11/1997 Hufschmid ..... H01H 50/443 335/132
5,867,081 A * 2/1999 Arnoux ..... H01H 51/22 335/132
6,911,884 B2 * 6/2005 Uotome ..... H01H 47/06 335/132
6,956,728 B2 * 10/2005 Zhou ..... H01H 9/563 361/160
7,098,763 B2 * 8/2006 Larcher ..... H01H 71/0207 335/132
7,760,055 B2 * 7/2010 Adunka ..... H01H 1/0015 335/132
7,852,178 B2 * 12/2010 Bush ..... H01H 51/2209 335/126
7,859,373 B2 * 12/2010 Yamamoto ..... H01H 50/305 335/126
8,138,440 B2 * 3/2012 Onufriyenko ..... H01H 73/045 218/154
8,248,193 B2 * 8/2012 Kaneda ..... F02N 15/067 335/126
8,638,531 B2 * 1/2014 Bhavaraju ..... H01H 47/18 361/2
8,791,777 B2 * 7/2014 Wan ..... H01H 50/326 335/132
9,064,664 B2 * 6/2015 Yamamoto ..... H01H 1/32
9,532,476 B2 * 12/2016 Mills ..... H01H 45/04
2002/0093774 A1 * 7/2002 Chung ..... H01H 9/542 361/2
2004/0109293 A1 * 6/2004 Apfelbacher ..... H01H 50/021 361/709
2007/0126538 A1 * 6/2007 Liu ..... H01H 50/32 335/172
2010/0165535 A1 * 7/2010 Pohl ..... H01F 7/1615 361/160
2010/0265629 A1 * 10/2010 Beckerman ..... H01H 47/22 361/160
2014/0265995 A1 * 9/2014 Kinsella ..... H02P 1/26 318/778
2015/0055268 A1 * 2/2015 Chapel ..... H01H 47/02 361/160
2015/0235791 A1 * 8/2015 Agarwal ..... H01H 50/54 361/57

* cited by examiner

GALVANICALLY ISOLATED HYBRID CONTACTOR

FIELD OF THE DISCLOSURE

The subject matter of the present disclosure generally relates to circuit control devices, and more particularly relates to a hybrid contactor built with both mechanical and semiconductor switching elements.

BACKGROUND OF THE DISCLOSURE

U.S. application Ser. No. 14/044,303, titled "Virtual Electronic Circuit Breaker" and commonly owned with the present patent application, discloses a hybrid contactor-based virtual circuit breaker with an electrical relay and control circuit, and is incorporated by reference herein in its entirety.

Control devices for circuits, such as switches, are important in many electrical applications. For instance, various circuit breaker designs that are useful in numerous applications have been previously developed and disclosed.

In current aerospace power distribution systems, electrical loads are fed through a thermal circuit breaker and a power relay connected in-series, in order to provide load and wire protection (over-current or "OC") and load On/Off control (switching). Alternatively, a Solid State Power Controller (SSPC) may be used to perform these same functions.

The thermal circuit breaker/power relay solution has a long service history, but this combination can be bulky and labor intensive for installation and trouble shooting. The SSPC solution has also been successfully implemented and operated with favorable service history. However, SSPCs are not cost and/or volume effective for higher power loads, largely due to the fact such applications require a high number of metal-oxide-semiconductor field-effect transistors (MOSFETs).

One problem with SSPCs is found with electrical loads greater than 120 VAC, or 25 Amps. In such ranges, SSPCs are large, inefficient and very costly to design and produce. A second problem is that SSPCs are not galvanically isolated, and have a non-zero leakage current when in the "off" state.

It would be desirable, therefore, to provide an electrically controlled switch or circuit breaker, also referred to as a contactor, that combines mechanical contacts and sold state switching elements to provide a small and cost-effective circuit breaker device that performs like an SSPC but also satisfies galvanic isolation requirements for both AC and DC applications The subject matter of the present disclosure is directed to overcoming, or at least reducing the effects of the problems set forth above.

BRIEF SUMMARY OF THE DISCLOSURE

Disclosed is a hybrid contactor that provides the ability to use the device with both AC and DC circuits. The contactor is particularly suited for use as an electronically controlled circuit breaker with loads using a 120 Volt AC power at greater than 25 Amps. In such scenarios, solid state electronic circuit breakers are large, inefficient, and very costly to design and produce.

The hybrid contactor includes a series-parallel arrangement of mechanical contacts with solid state devices. This increases the switching capacity of the mechanical contacts, and maintains galvanic isolation when open.

In accordance with the invention, two mechanical contacts are used in series (known as a double-gap contactor), for switching. The contacts are used with one single activating electromagnetic actuator. Closure of the contacts is mechanically arranged, so that one contact closes shortly before the closure of the second contact. The second contact forms a parallel circuit with an electronic switch. The electronic switch may be formed from one or more of semiconductor devices, such as silicon-controlled rectifiers (SCRs), field-effect transistors (FETs), or transistors.

The disclosed subject matter presents several advantages over previously available systems and methods.

One advantage of the disclosed subject matter is that it allows for galvanic isolation between input and output when the contactor is off.

Another advantage of the disclosed subject matter is that it provides arc-less switching, reducing degradation of the inventive device.

Yet another advantage of the disclosed subject matter is that an inexpensive semiconductor may be utilized.

Yet another advantage of the disclosed subject matter is that heat dissipation from the inventive device is greatly reduced.

Yet an additional advantage of the disclosed subject matter is elimination of relay contact failure.

BRIEF DESCRIPTION OF THE DRAWINGS

The foregoing summary, preferred embodiments, and other aspects of the subject matter of the present disclosure will be best understood with reference to a detailed description of specific embodiments, which follows, when read in conjunction with the accompanying drawings, in which.

Like reference numbers and designations in the various drawings indicate like elements. Arrows in the schematic drawings should be understood to represent logic pathways that are generally indicative of the flow direction of information or logic, and that such arrows do not necessarily represent traditional electrical pathways.

DETAILED DESCRIPTION OF THE DISCLOSURE

Figure 1:
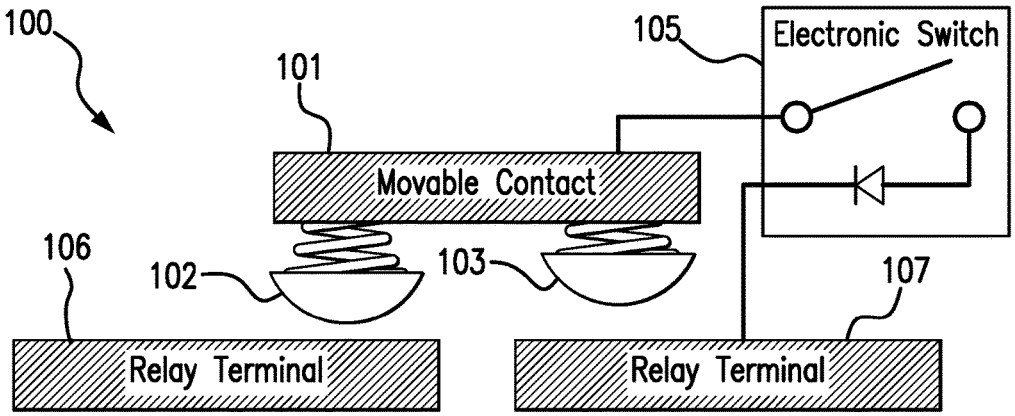
FIG. 1 is a diagram of an embodiment of the invention, illustrating the series-parallel arrangement.

FIG. 1 is a schematic diagram of one embodiment of the inventive hybrid contactor 100. A movable contact 101 includes two mechanical contacts 102 and 103 used in series. Mechanical contacts 102 and 103 form a double gap contactor, with a single activating electromagnetic actuator. Mechanical contacts 102 and 103 are mechanically arranged in accordance with the invention such that, upon activation of the magnetic contact closure device, contact 102 closes shortly before the second of contact 103.

The second mechanical contact 103 is electronically arranged in a parallel circuit 104 to an electronic switch 105. Electronic switch 105 may include one or more semiconductor devices, such as an SCR, FET, transistor, or any other suitable semiconductor device.

In an illustrative sequence, closure of the first contact 102 causes power to be applied to the electronic switch 105. The electronic switch 105 begins conducting current in parallel 104 with the second contact 103. Shortly after the electronic switch 105 begins flowing current through the device, the second contact 103 closes. Closure of the second contact 103 causes a shorting out of the electronic switch 105.

Opening of the contacts is performed in the exact reverse sequence. Contact 103 opens first, causing the load current to flow through electronic switch 105. Switch 105 is then turned off before contact 102 begins to open. In accordance with the invention, all switching stress is borne by the electronic switch 105, and no arcs are initiated in mechanical contacts 102, 103 at any time.

Electronic switch 105 carries at least some current at all times, when both contacts 102 and 103 are closed. At the times when the contact 103 is open and contact 102 is closed, electronic switch 105 carries the entire load current. By carrying the entire load current during an opening or closing of contacts, switching stress on the relay contacts 106 and 107 is substantially reduced or eliminated. Switching stress is a major cause of relay degradation, and thus elimination of switching stress greatly reduces relay degradation and prolongs the service life of the contactor device.

Semiconductor device 105*a* (not shown) is only utilized to handle current during switching transitions, thereby only causing minimal heat dissipation (which results from semiconductor use) and stress. Thus, infrequent use of semiconductor device 105*a*, e.g. only during switching transitions, reduces heat dissipation and stress. When the semiconductor device 105*a* is off, galvanic isolation (e.g., an air gap) is present between input and output. Additionally, galvanic isolation is also present between relay terminals 106 and 107 and ground.

It should be noted that the invention is specifically contemplated using an SCR or triode for alternating current (TRIAC) as the electronic switch for AC devices, and FET, Insulated Gate Bipolar Transistors (IGBT), or Bipolar Junction Transistors (BJT) as the electronic switch for either AC or DC devices. However, any other suitable electronic switch is contemplated by the invention, and can be utilized in accordance with the inventive process disclosed herein.

Figure 2:
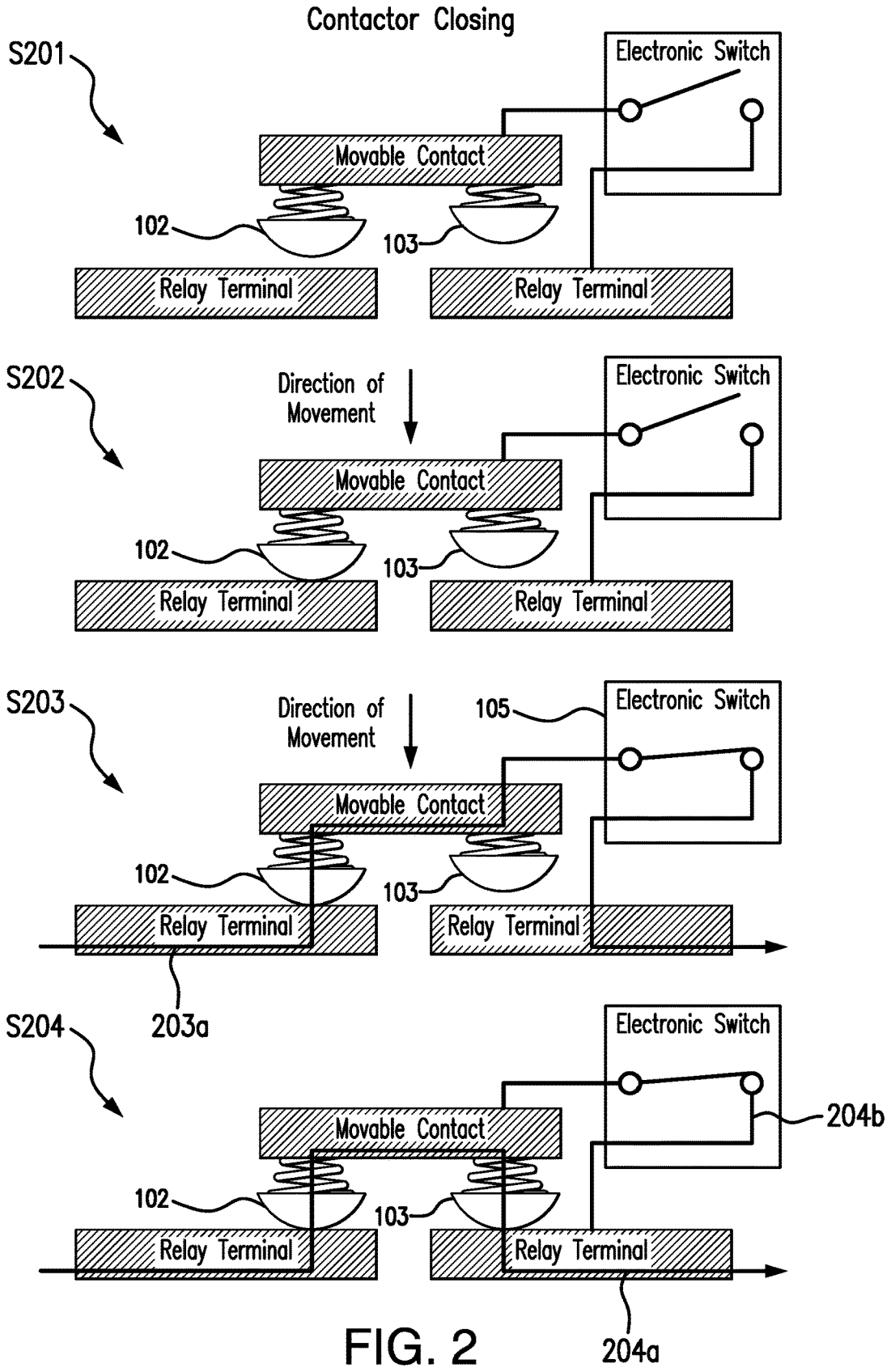
FIG. 2 is a schematic diagram of the contactor closing in accordance with the invention.

FIG. 2 is a schematic diagram illustrating an embodiment of the invention. In FIG. 2, the contactor 100 of FIG. 1 is illustrated moving to a closed position.

At S201, the inventive hybrid contactor is illustrated in initial position. Contacts 102 and 103 are illustrated in a switched open position. Electronic switch 105 is open, and no current is flowing. Input to output are galvanically isolated, forming an air gap.

At S202, an intermediate position, mechanical contact 102 closes, as a result of movement of the movable contact 101 in the direction toward (or downward to) relay terminals 106 and 107. This causes the mechanical contact 102 to make contact with relay terminal 106, halting galvanic isolation. At this stage, electronic switch 105 is still in an open position, and no current is therefore flowing in the circuit.

At S203, a subsequent intermediate position, electronic switch 105 is now closed. As shown, current begins to flow at this position. Illustrative flow of current is shown as path 203*a*. At this position, voltage across the electronic switch is less than 8V.

At S204, the inventive hybrid contactor is shown in a final closed position. At this position, the second mechanical contact 103 closes, making electrical contact with relay terminal 107. This causes electronic switch 105 to be shorted as a result of the closure of mechanical contact 103. As a result of the shorting out of electronic switch 105, a substantial portion of the electrical current changes the path of flow, shifting to a low resistance mechanical path. The low resistance mechanical path is shown in path 204*a*, while the former path is illustrated in 204*b*.

Figure 3:
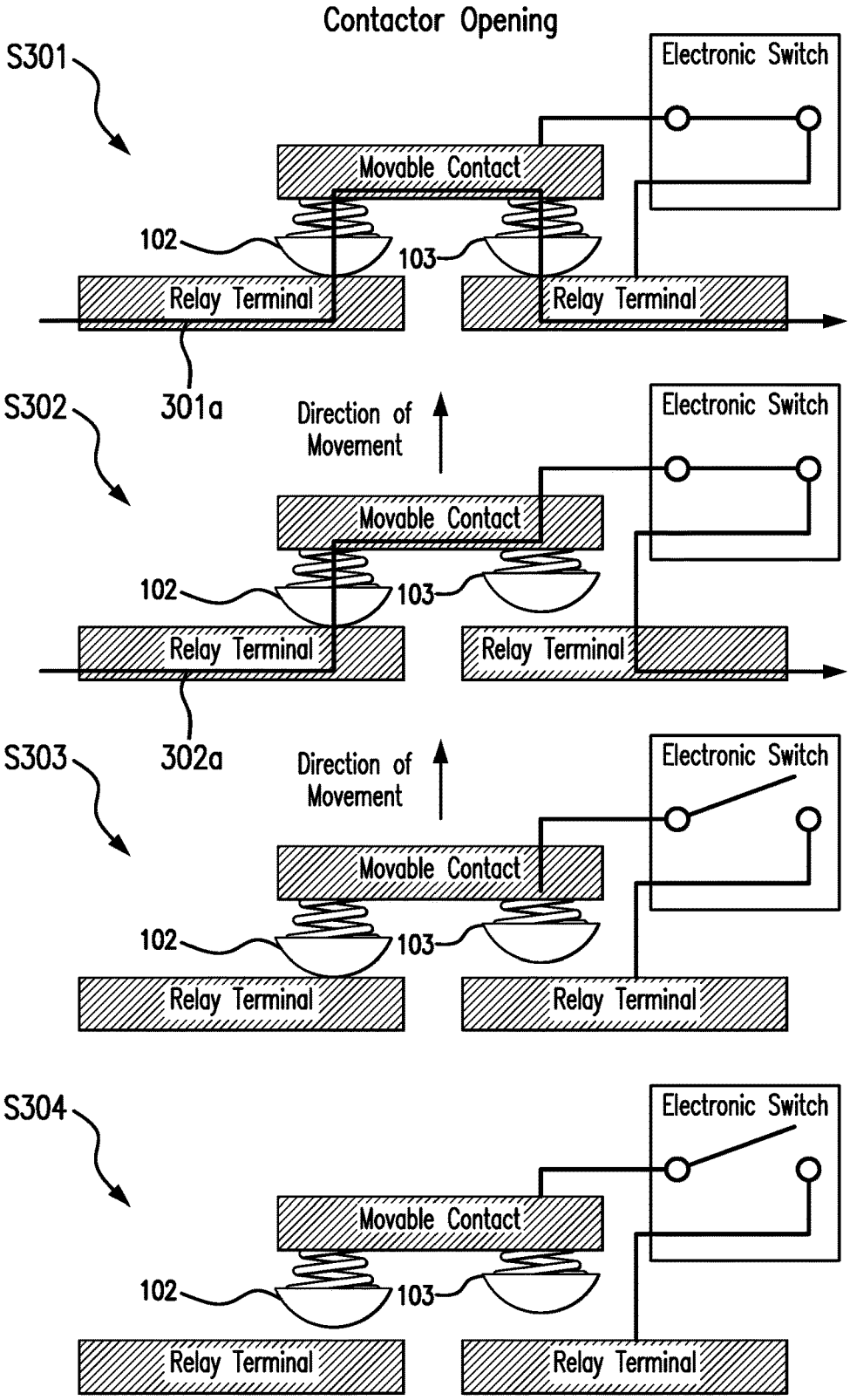
FIG. 3 is a schematic diagram of the contactor opening in accordance with the invention.

FIG. 3 is a schematic diagram illustrating an exemplary embodiment of the opening of hybrid contactor 100 in accordance with the invention.

At S301, hybrid contactor 100 is shown in an initial closed position. At this position, previously illustrated in S204, mechanical contacts 102 and 103 are in electrical contact with relay terminals 106 and 107, respectively, and form a closed circuit. The electronic switch 105 is closed, and current flows through path 301*a*. Thus, at this position, current is not flowing through the semiconductor device 105*a*.

At S302, an intermediate position, moveable contact 101 moves in an upward position, away from relay terminals 106 and 107. Mechanical contact 103 opens, releasing contact from relay terminal 107 and forming an open position. At this point, all current flows through mechanical contact 102 and then into electronic switch 105. It is at this stage, during the relay switching operation, that semiconductor device 105*a* must carry the current. Voltage of less than 8V now moves across the electronic switch 105. Illustrative path 302*a* shows the flow of the current at this position.

At S303, a subsequent intermediate position, electronic switch 105 opens, halting all current flow. At this point, no more current is being carried by semiconductor device 105*a*. Thus, while mechanical contact 102 remains in electrical contact with relay terminal 106, the opening of electronic switch 105 prevents formation of a closed circuit and therefore the flow of current.

At S304, the final position, mechanical contact 102 releases contact from relay terminal 106, forming an open position. At this point, both mechanical contacts 102 and 103, as well as electronic switch 105, are in an open position, and no current is flowing. The input to output is now galvanically isolated.

In view of the foregoing embodiments, an advantage of the inventive hybrid contactor 100 allows for galvanic isolation between the input and output. By providing an air gap between the first contact 102 and relay terminal 106, true galvanic isolation is provided between input and output when the contactor is off. This allows for high potential to be applied between input and output, or between both terminals and ground, all the way up to the voltage limit, which is determined by the distance of the air gap.

An additional advantage of the inventive hybrid contactor is arc-less switching. That is, during switching, the mechanical contacts 102 and 103 do not arc, ensuring little or no contact degradation during operation of the hybrid contactor. By only requiring the semiconductor device 105*a* to carry current for a short time during the relay switching operation, a relatively small and inexpensive semiconductor may be utilized. During normal operation, the mechanical contacts 102 and 103 carry all the current, which causes the semiconductor device 105*a* to dissipate no heat, and therefore further reduces the cost and complexity by not requiring a large heat sink.

Yet an additional advantage of the inventive hybrid contactor is elimination of mechanical vibration arcing and subsequent failure of the relay contacts.

It should be understood that various components of the disclosed subject matter may communicate with one another in various manners. For instance, components may communicate with one another via a wire or, alternatively, wirelessly and by electrical signals or via digital information. It is noted that PWB may be utilized in the construction of many embodiments.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. A hybrid contactor device, comprising:

a moveable conductive metal bar including a first mechanical contact and a second mechanical contact;

a first terminal configured to electrically engage the first mechanical contact and a second terminal configured to electrically engage the second mechanical contact, the first terminal mechanically offset from the second terminal; and a solid state MOSFET switch in parallel with the second mechanical contact, the switch configured to control both an AC current carrying breaker and a DC current carrying breaker;

wherein:

when the first mechanical contact is open, galvanic isolation is formed between input and output;

when the first mechanical contact is in a closed position, an electrical and mechanical contact is configured to form with the first terminal relay, the closed position effective to cause power to be applied to the solid state MOSFET switch; and after a delay caused by the mechanically offset configuration, the second mechanical contact is configured to move to the closed position while the first mechanical contact remains closed, causing a shorting of the solid state MOSFET switch; and preventing formation of an arc by causing the power to be applied to the solid state MOSFET switch.

2. The contactor device of claim 1 wherein, after the delay, the solid state switch causes current to flow through the contactor device.

3. The contactor device of claim 1 wherein the first mechanical contact and the second mechanical contact are arranged in series.

4. The contactor device of claim 1 wherein the solid state switch is arranged in parallel to the second mechanical contact.

5. The contactor device of claim 1 wherein the first mechanical contact and the second mechanical contact form a double gap contactor with a single activating electromagnetic actuator.

6. The contactor device of claim 1 wherein the solid state switch includes a semiconductor device.

7. The contactor device of claim 6 wherein the semiconductor device is selected from a group consisting of a silicon-controlled rectifier (SCR), field-effect transistor (FET) or other type of transistor.

8. The contactor device of claim 1 wherein the solid state-switch is selected from a group consisting of SCR, three-terminal semiconductor (TRIAC), FET, insulated-gate bipolar transistor (IGBT), or bipolar junction transistor (BJT) switches.

9. A method of operating a hybrid contactor device, comprising the steps of:

providing a first mechanical contact;

providing a second mechanical contact;

providing a bilateral solid state MOSFET switch in communication with the second mechanical contact, the switch configured to control both an AC-type and a DC-type breaker;

providing a first terminal;

receiving, via the first terminal, an electrical engagement from the first mechanical contact;

providing a second terminal; and receiving, via the second terminal, an electrical engagement from the second mechanical contact;

closing the first mechanical contact, the closing comprising forming mechanical and electrical contact with the first terminal;

causing power to be applied to the solid state MOSFET switch;

conducting, via the solid state MOSFET switch, current in parallel with the second contact;

closing the second mechanical contact while the first mechanical contact remains closed, the closing comprising forming mechanical and electrical contact with the second relay terminal;

causing a shorting of the solid state MOSFET switch, the shorting causing power to be applied to the solid state MOSFET switch and preventing any formation of an arc;

completing the shorting of the solid state switch prior to opening the first contact; and wherein when the first mechanical contact and second mechanical contact are open, galvanic isolation is formed between input and output.

10. The method of claim 9 wherein, when either of the first mechanical contact or the second mechanical contact are in a closed position, the solid state switch is configured to carry an entire current load.

11. The method of claim 9 wherein, when the first mechanical contact is closed, the solid state switch remains in an open position, and does not flow current through the circuit.

12. The method of claim 9 wherein, upon closure of the second mechanical contact, the solid state switch is shorted, the short effective to cause a substantial portion of the electrical current to change its flow to a low-resistance mechanical path.

13. The method of claim 9 wherein, when the first mechanical contact is in a closed position and the second mechanical contact is still in a switched open position, the method further comprises flowing all current through the first mechanical contact and into the solid state switch.

* * * * *